US006763805B2

(12) United States Patent
Tokiya et al.

(10) Patent No.: US 6,763,805 B2
(45) Date of Patent: Jul. 20, 2004

(54) INTAKE AIR THROTTLE VALVE DEVICE

(75) Inventors: Satoru Tokiya, Tokyo (JP); Teruhiko Moriguchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/217,499

(22) Filed: Aug. 14, 2002

(65) Prior Publication Data

US 2003/0159676 A1 Aug. 28, 2003

(30) Foreign Application Priority Data

Feb. 25, 2002 (JP) ..... 2002-047748

(51) Int. Cl.[7] ..... F02D 1/00
(52) U.S. Cl. ..... 123/399
(58) Field of Search ..... 123/399, 396, 123/398, 403

(56) References Cited

U.S. PATENT DOCUMENTS 5,492,097 A 2/1996 Byram et al.
5,775,292 A * 7/1998 Seeger ..... 123/396
6,360,718 B1 * 3/2002 Wicker ..... 123/396
6,397,815 B1 * 6/2002 von Werder ..... 123/396
6,543,416 B2 * 4/2003 Kowatari et al. ..... 123/399
6,640,776 B2 * 11/2003 Torii ..... 123/396

FOREIGN PATENT DOCUMENTS

JP 10-196412 7/1998

* cited by examiner

*Primary Examiner*—Mahmoud Gimie
*Assistant Examiner*—Arnold Castro
(74) *Attorney, Agent, or Firm*—Sughrue Mion, PLLC

(57) ABSTRACT

An intake air throttle valve device is capable of statically determining the opening of a throttle valve by balance between a driving force from a motor and an elastic force from an elastic member, thus making it possible to prevent the occurrence of a range in which it is impossible to control the opening of the throttle valve in accordance with the amount of electric power supplied to the motor. The intake air throttle valve device of the present invention is provided, in an intermediate portion of the elastic member with a load applying element for causing the elastic member to generate a force to oppose the force of a throttle gear thereby to apply a load to the throttle gear. The load applying element includes a third engagement portion, a first abutment portion and a second abutment portion.

10 Claims, 10 Drawing Sheets

INTAKE AIR THROTTLE VALVE DEVICE

This application is based on Application No. 2002-047748, filed in Japan on Feb. 25, 2002, the contents of which are hereby incorporated by reference.

BACKGROUND OF THE INVENTION

1. Field of the Invention

The present invention relates to an intake air throttle valve device for controlling the amount of intake air in accordance with the traveling condition of a vehicle.

2. Description of the Related Art

FIG. 7 is a front elevational view of an intake air throttle valve device, and FIG. 8 is a right side view of FIG. 7.

This intake air throttle valve device includes a rotatable throttle shaft 3 extending through a body 1 in which an intake passage 2 is formed, a throttle valve 4 fixedly secured to the throttle shaft 3, a throttle gear 5 fixedly mounted on an end portion of the throttle shaft 3, a motor gear 6 which is in meshing engagement with the throttle gear 5, a motor shaft 7 of a motor 8 having one end thereof fixedly attached to the motor gear 6, and an elastic member 9 which is arranged to surround the throttle shaft 3 for stopping the throttle valve 4 at a prescribed angle of rotation by balance between a force from the throttle gear 5 and an opposing elastic force of the elastic member 9, which acts in a direction oppose to the force from the throttle gear 5.

The elastic member 9 is made of rubber in the form of a segmental shape which is a partially cut-away circle. The elastic member 9 is formed at its opposite ends with a first engagement portion 9*a* and a second engagement portion 9*b*, respectively, both extending in a diametral or radial direction. In addition, the first engagement portion 9*a* is in abutment against a first abutment surface 10*a* of an arc-shaped and belt-shaped stopper 10 which is formed on and protruded from the body 1. The second engagement portion 9*b* is in abutment against a second abutment surface 10*b* of the stopper 10.

Moreover, the first engagement portion 9*a* of the elastic member 9 is pressed by a first extension 5*a* extending from a strut or column 5*c* of the throttle gear 5 in the clockwise direction, so that the elastic member 9 is subjected to compressive deformation in the clockwise direction. Also, the second engagement portion 9*b* of the elastic member 9 is pressed by a second extension 5*b* extending from the strut 5*c* of the throttle gear 5 in the counterclockwise direction, so that the elastic member 9 is subjected to compression deformation in the counterclockwise direction.

In the intake air throttle valve device as constructed above, the amount of opening or opening degree of the throttle valve 4 is proportional to the amount of operation of an accelerator pedal associated therewith, and the throttle valve 4 serves to adjust the amount of intake air passing through the intake passage 2 in consideration of the operating condition of a vehicle such as, for example, wheel slippage or the like due to differences or variations in rotation of the front and rear wheels, thereby controlling the output power of an internal combustion engine installed on the vehicle. Therefore, the opening and closing operation of the throttle valve 4 is performed under the drive of the motor 8 which is operated on the basis of the amount of operation of the accelerator pedal and data of slippage (slip amounts) or the like, instead of using a direct structure such as a link mechanism directly connecting between the accelerator pedal and the throttle valve.

In this intake air throttle valve device, the motor gear 6 is driven to rotate by energizing the motor 8, so that the throttle gear 5, which is in meshing engagement with the motor gear 6, is thereby turned, thus causing the throttle shaft 3 and the throttle valve 4 integral with the throttle gear 5 to rotate, too. At this time, the elastic force from the elastic member 9 acts on the throttle gear 5 in a direction opposite the rotational direction of the throttle gear 5, so that the throttle valve 4 is stopped at a position at which the rotational force of the throttle gear 5 becomes in balance with the elastic force of the elastic member 9.

The rotational angle of the throttle valve 4 is detected by an opening sensor (not shown) so that a rotational angle signal of the opening sensor is sent as an output value to a control circuit (not shown) where it is determined whether the output value has reached a set target value. When the output value has not yet reached the set target value, the current value of the motor 8 is controlled by a signal from the control circuit whereby the torque of the throttle shaft 3 is adjusted to stop the throttle valve 4 at a new rotational angle.

Next, reference will be made to a mechanism through which the elastic force of the elastic member 9 becomes in balance with the rotational force of the throttle gear 5.

For instance, when the throttle valve 4 in the state of FIG. 7 is to be turned in the clockwise or opening direction, the throttle gear 5 is caused to rotate in the clockwise direction by a driving force applied thereto from the motor 8 through the motor gear 6, whereby the first extension 5*a* pushes the first engagement portion 9*a*. At this time, since the second engagement portion 9*b* is in abutment against the second abutment surface 10*b* of the stopper 10, the elastic member 9 is compressively deformed in accordance with the clockwise rotation of the first engagement portion 9*a*, whereby the elastic force of the elastic member 9 is increased with the increasing compressive deformation thereof. When the elastic force of the elastic member 9 becomes balanced with the rotational force of the throttle gear 5, the rotation of the throttle valve 4 is stopped. FIG. 9 shows the state at that time.

On the other hand, when the throttle valve 4 is to be rotated in the closing direction from its fully opened state, the amount of electric power supplied to the motor 8 is reduced to decrease the driving force of the motor 8, whereby the elastic force of the compressed elastic member 9 acting in the counterclockwise direction overcomes the clockwise rotational force acting on the throttle gear 5. As a result, the throttle gear 5 is caused to rotate in the counterclockwise direction through the first engagement portion 9*a* and the first extension 5*a*. Thus, the elastic member 9 is expanded in accordance with the rotation of the throttle gear, thereby reducing the elastic force of the elastic member 9. When the elastic force of the elastic member 9 becomes balanced with the rotational force of the throttle gear 5, the rotation of the throttle valve 4 is stopped.

Here, note that when the throttle valve 4 is fully closed, the second extension 5*b* and the second engagement portion 9*b* are placed in abutment with each other, and the first engagement portion 9*a* and the first abutment surface 10*a* are also placed in abutment with each other, so the elastic force of the elastic member 9 acts on the throttle valve 4 in the opening direction.

In addition, when the throttle valve 4 is fully opened, the first extension 5*a* and the first engagement portion 9*a* are placed in abutment with each other, and the second engagement portion 9*b* and the second abutment surface 10*b* are also placed in abutment with each other, so the elastic force of the elastic member 9 acts on the throttle valve 4 in the closing direction.

In the above-mentioned intake air throttle valve device, at the instant when the elastic force of the elastic member 9 becomes balanced with the rotational force of the throttle gear 5, the rotation of the throttle valve 4 is stopped. Thus, when the motor 8 is not energized, the first engagement portion 9*a* of the elastic member 9 must be in abutment with the first abutment surface 10*a* of the stopper 10 and the first extension 5*a*, and the second engagement portion 9*b* of the elastic member 9 must be in abutment with the second abutment surface 10*b* of the stopper 10 and the second extension 5*b*.

However, when gaps or clearances are developed between the first and second engagement portions 9*a*, 9*b* and the stopper 10 due to dimensional errors or the like in the first and second engagement portions 9*a*, 9*b*, the first and second extensions 5*a*, 5*b* and the stopper 10, there arises the following problems.

That is, in FIG. 7, when the throttle valve 4 is to be turned in the closing or counterclockwise direction, the throttle gear 5 is caused to rotate in the counterclockwise direction under the action of the driving force from the motor 8 through the motor gear 6, whereby the second extension 5*b* pushes the second engagement portion 9*b*. At this time, since there is a gap A between the first engagement portion 9*a* and the first abutment surface 10*a* of the stopper 10, the first engagement portion 9*a* pushes the first extension 5*a* without pressing the first abutment surface 10*a* of the stopper 10. As a result, the elastic member 9 is caused to rotate as it is without being subjected to counterclockwise compressive deformation, that is, the throttle gear 5 is turned in a no-load state without receiving the elastic force of the elastic member 9. Consequently, the opening of the throttle valve 4 can not be controlled according to the amount of electric power supplied to the motor 8 in a rotational range of the gap A, as shown by broken lines in FIG. 10, thus adversely influencing the rotational speed control of the internal combustion engine.

SUMMARY OF THE INVENTION

The present invention is intended to solve the problem as referred to above, and has for its object to provide an intake air throttle valve device in which even if there would be developed gaps between engagement portions and a stopper due to dimensional errors in the engagement portions, extensions and the stopper, the influence of the gap on the control of the opening of a throttle valve can be reduced.

In order to achieve the above object, the present invention resides in an intake air throttle valve device which includes: a motor; a body having an intake passage formed therein; a throttle shaft extending through the body; a throttle valve fixedly secured to the throttle shaft; a throttle gear fixedly attached to an end portion of the throttle shaft for transmitting a driving force from the motor to the throttle shaft thereby to open or close the throttle valve; and an elastic member or a coiled torsion spring arranged to surround the throttle shaft for stopping the throttle valve at a prescribed angle of rotation by balance between a force from the throttle gear and an opposing elastic force of the elastic member or coiled torsion spring. The elastic member or coiled torsion spring is engaged at one end thereof with an end face of a stopper provided on the body, and at the other end thereof with the throttle gear, so that the elastic force of the elastic member or coiled torsion spring can be changed by the deformation of the elastic member or coiled torsion spring in accordance with the operation of the throttle gear. In an intermediate portion of the elastic member or coiled torsion spring, there is provided a load applying element for causing the elastic means to generate a force to oppose the force of the throttle gear thereby to apply a load to the throttle gear.

With the above arrangement, even in cases where there is a gap between an end of the throttle gear and an adjacent end face of a stopper, the throttle gear is able to receive the elastic force of the elastic member in the entire operating range of the throttle gear. As a result, the opening of a throttle valve can be statically determined by balance between the force from the throttle gear and the elastic force from the elastic member, thus making it possible to prevent the occurrence of a range in which it is impossible to control the opening of the throttle valve in accordance with the amount of electric power supplied to the motor.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 7:
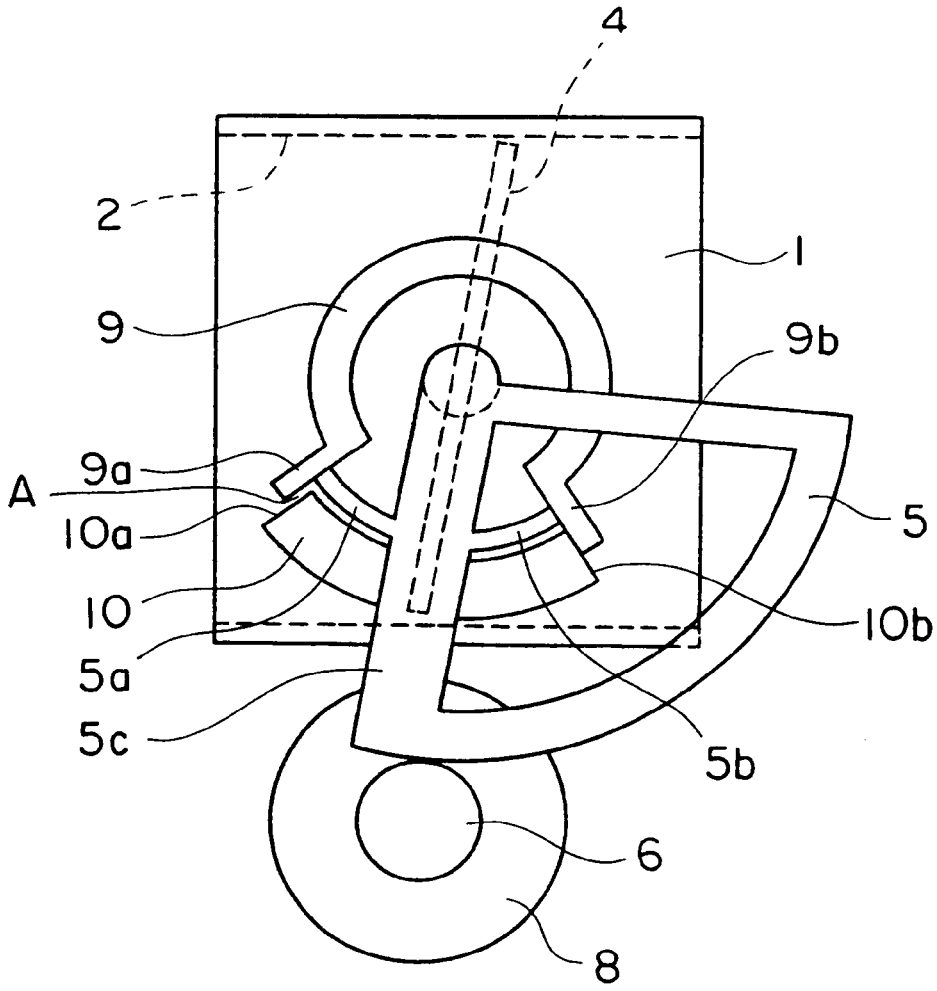
FIG. 7 is a front elevational view of a known intake air throttle valve device.
Figure 8:
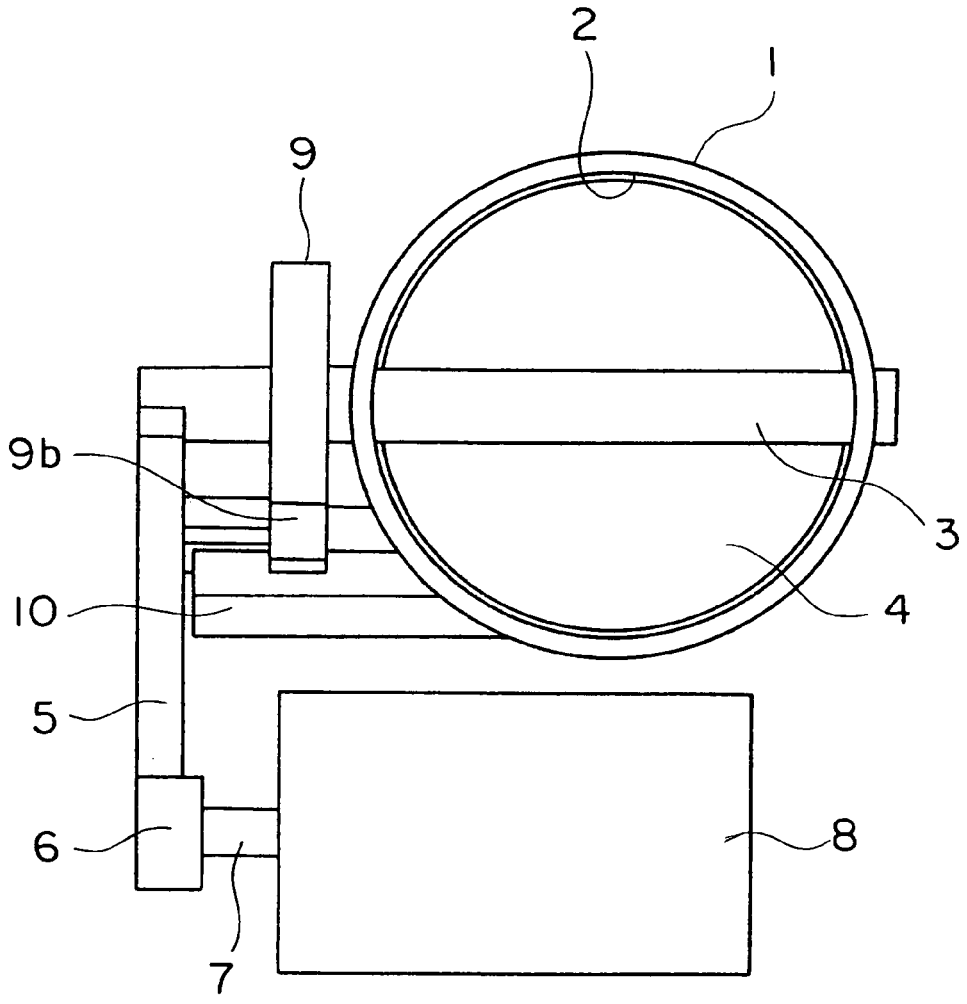
FIG. 8 is a side view of the intake air throttle valve device of FIG. 7.
Figure 9:
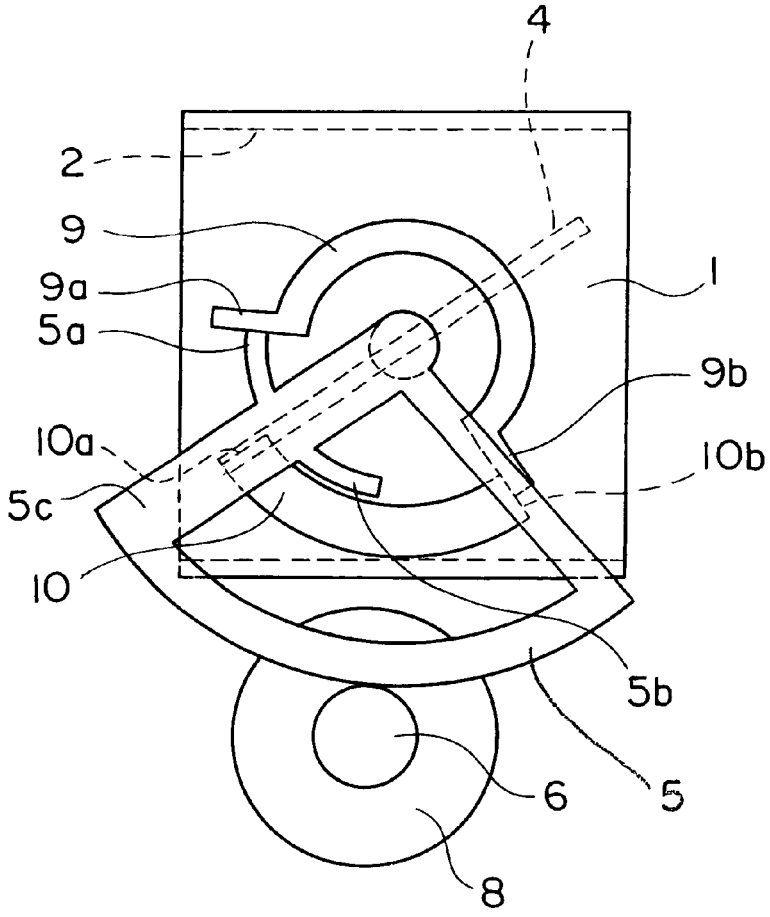
FIG. 9 is a front elevational view showing another mode of use of the intake air throttle valve device of FIG. 7.

Hereinafter, preferred embodiments of the present invention will be described in detail while referring to the accompanying drawings. The same or corresponding members and parts of the embodiments as those shown in FIGS. 7 through 9 are identified by the same symbols.

Embodiment 1.

Figure 1:
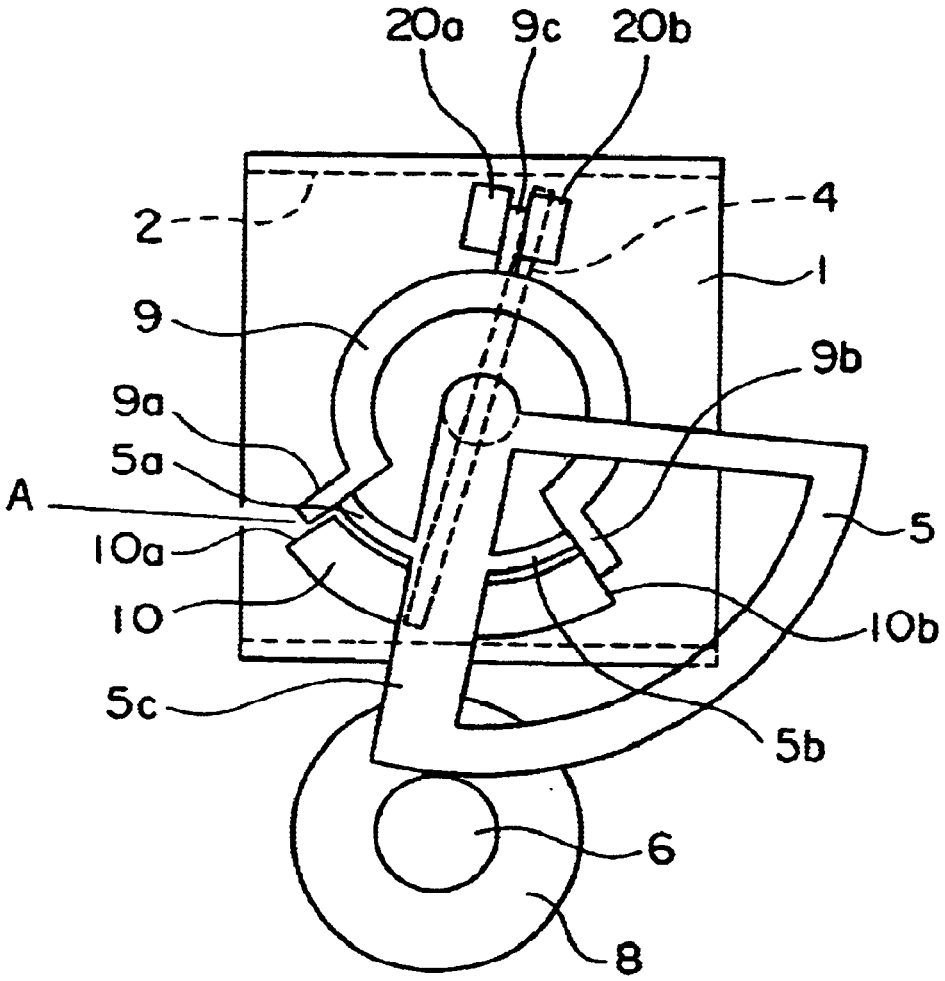
FIG. 1 is a front elevational view of an intake air throttle valve device according to a first embodiment of the present invention.
Figure 2:
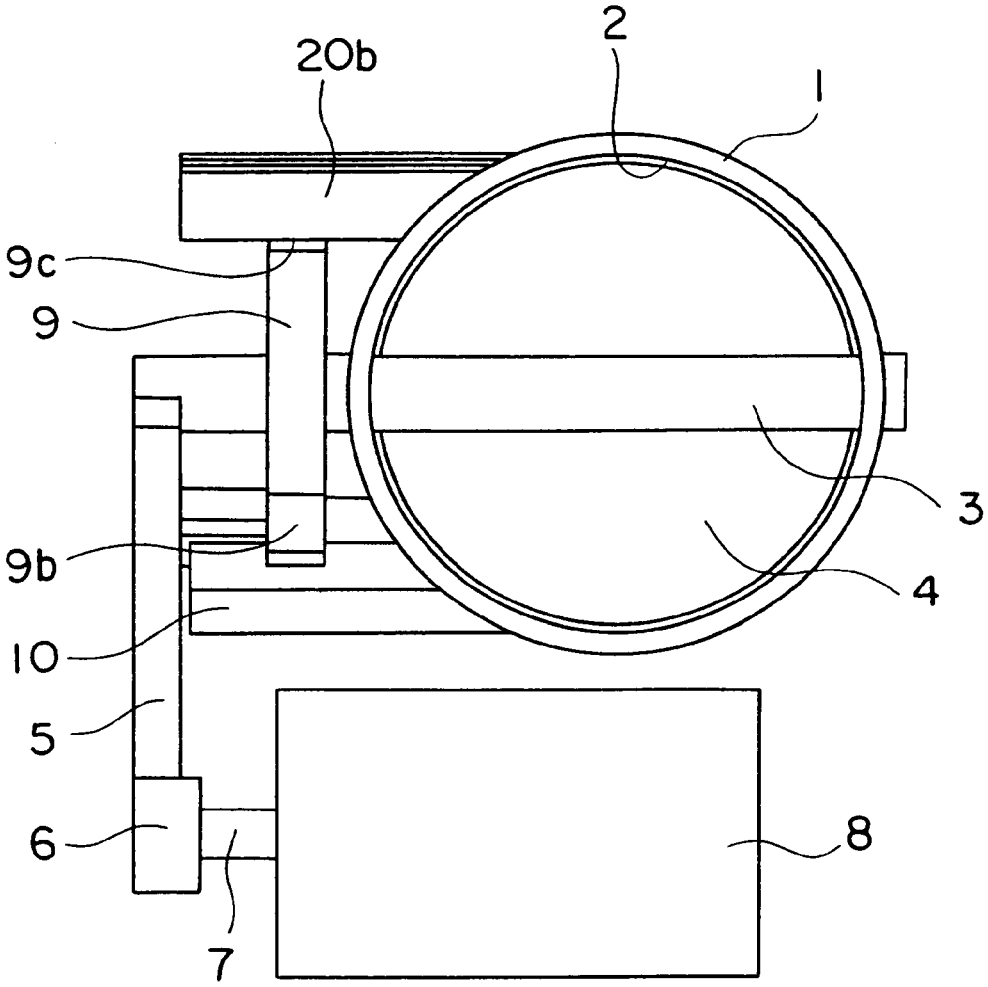
FIG. 2 is a side view of the intake air throttle valve device of FIG. 1.

FIG. 1 is a front elevational view of an intake air throttle valve device according to a first embodiment of the present invention, and FIG. 2 is a right side view of the intake air throttle valve device of FIG. 1.

The intake air throttle valve device illustrated includes a rotatable throttle shaft 3 extending through a body 1 in which an intake passage 2 is formed, a throttle valve 4 which is fixedly secured to the throttle shaft 3, a driving force transmission means in the form of a throttle gear 5 which is fixedly mounted on an end portion of the throttle shaft 3, a motor gear 6 which is in meshing engagement with the throttle gear 5, a motor shaft 7 of a motor 8 which has one end thereof fixedly attached to the motor gear 6, and a resilient means in the form of an elastic member 9 which is arranged to surround the throttle shaft 3 for stopping the throttle valve 4 at a prescribed angle of rotation by balance between a force from the throttle gear 5 and an opposing elastic force of the elastic member 9, which acts in a direction oppose to the force from the throttle gear 5.

The elastic member 9 is made of rubber in the form of a segmental shape which is a partially cut-away circle. The elastic member 9 is formed at its opposite ends with a first engagement portion 9*a* and a second engagement portion 9*b*, respectively, both extending in a diametral or radial direction. In addition, the first engagement portion 9*a* is in abutment against a first abutment surface 10*a* of an arc-shaped and belt-shaped stopper 10 which is formed on and protruded from the body 1. The second engagement portion 9*b* is in abutment against a second abutment surface 10*b* of the stopper 10.

Moreover, the first engagement portion 9*a* of the elastic member 9 is pressed by a first extension 5*a* extending from a strut or column 5*c* of the throttle gear 5 in the clockwise direction, so that the elastic member 9 is subjected to compressive deformation in the clockwise direction. Also, the second engagement portion 9*b* of the elastic member 9 is pressed by a second extension 5*b* extending from the strut 5*c* of the throttle gear 5 in the counterclockwise direction, so that the elastic member 9 is subjected to compression deformation in the counterclockwise direction.

In addition, the intake air throttle valve device is provided with a load applying means which is arranged in an intermediate portion of the elastic member 9 for generating a force in the elastic member 9 to oppose the force of the throttle gear 5 thereby to apply a load to the throttle gear 5.

The load applying means includes a third engagement portion 9*c* protruding from the elastic member 9 in a diametral direction, and a first abutment portion 20*a* and a second abutment portion 20*b* both provided on the body 1 with the third engagement portion 9*c* being clamped therebetween in abutment therewith. With this arrangement, a load is generated by the compressive deformation of the elastic member 9.

In the intake air throttle valve device as constructed above, by energizing the motor 8, the motor gear 6 is driven to turn whereby the throttle gear 5 in meshing engagement with the motor gear 6 is caused to rotate. As a result, the throttle shaft 3 and the throttle valve 4 being integral with the throttle gear 5 are driven to turn. At this time, the elastic force of the elastic member 9 acts on the throttle gear 5 in a direction opposite to the rotational direction thereof, so that the throttle valve 4 is stopped at a location at which the elastic force of the elastic member 9 becomes in balance with the rotational force of the throttle gear 5.

The rotational angle of the throttle valve 4 is detected by an opening sensor (not shown), which generates a corresponding rotational angle signal to a control circuit (not shown) as an output value. The control circuit determines whether the output value has reached a set target value. When the output value has not yet reached the set target value, the current value supplied to the motor 8 is controlled by a signal from the control circuit whereby the torque of the throttle shaft 3 is adjusted in such a manner that the throttle valve 4 is stopped at a new rotational angle.

Figure 3:
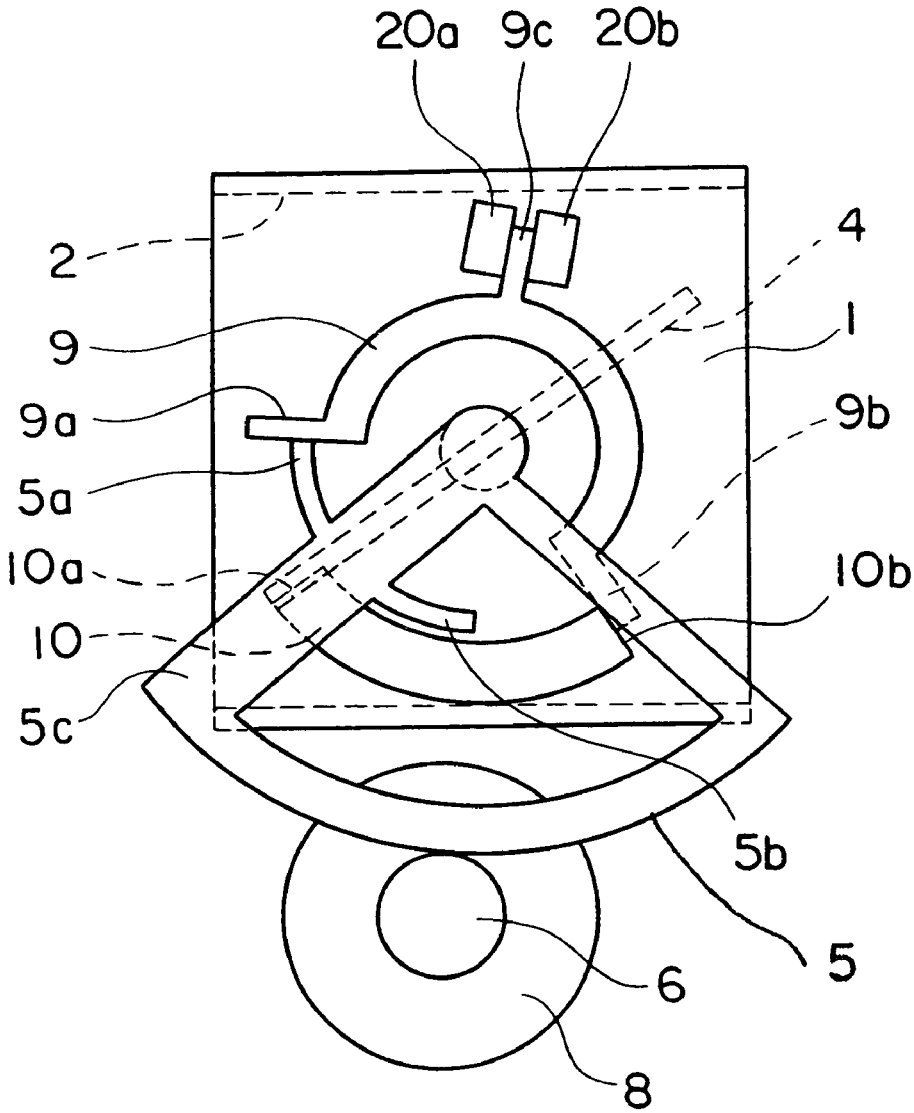
FIG. 3 is a front elevational view showing another mode of use of the intake air throttle valve device of FIG. 1.

On the other hand, when the throttle valve 4 in the state of FIG. 1 is to be turned in the opening or clockwise direction, the throttle gear 5 is driven to turn in the clockwise direction by the driving force from the motor 8 through the motor gear 6, so that the first extension 5*a* pushes the first engagement portion 9*a*, and the third engagement portion 9*c* pushes the second abutment portion 20*b*. At this time, the second engagement portion 9*b* presses the second abutment surface 10*b* of the stopper 10. Accordingly, the first engagement portion 9*a* of the elastic member 9 is caused to turn in the clockwise direction to compressively deform the elastic member 9, as shown in FIG. 3. As a result, the elastic force of the elastic member 9 is increased in accordance with the increasing deformation thereof, so that when the elastic force becomes balanced with the rotational force of the throttle gear 5, the turning of the throttle valve 4 is stopped.

On the other hand, when the throttle valve 4 is to be turned in the closing direction from its fully opened position, the value of electric power supplied to the motor 8 is reduced to decrease the driving force of the motor 8, thus permitting the counterclockwise elastic force of the compressed elastic member 9 to overcome the clockwise rotational force acting on the throttle gear 5. As a result, the throttle gear 5 is driven to rotate in the counterclockwise direction through the first engagement portion 9*a* and the first extension 5*a*, thus causing the elastic member 9 to expand in accordance with the rotation of the throttle gear 5. Accordingly, the elastic force of the elastic member 9 is reduced so that when the elastic force becomes balanced with the rotational force of the throttle gear 5, the turning of the throttle valve 4 is stopped.

Moreover, in FIG. 1, when the throttle valve 4 is to be turned in the closing or counterclockwise direction, the throttle gear 5 is caused to turn in the counterclockwise direction by the driving force from the motor 8 through the motor gear 6, so that the second extension 5*b* pushes the second engagement portion 9*b*. At this time, since there is a gap A between the first engagement portion 9*a* and the first abutment surface 10*a* of the stopper 10, the first engagement portion 9*a* does not push the first abutment surface 10*a* of the stopper 10, but the third engagement portion 9*c* pushes the first abutment portion 20*a*. Thus, the elastic member 9 is compressively deformed on its side near the second engagement portion 9*b*, and the elastic force of the elastic member 9 generated in accordance with the compressive deformation thereof is applied to the throttle gear 5 in the clockwise direction.

That is, the throttle gear 5 receives the elastic force from the elastic member 9 even when there is the gap A between the first engagement portion 9*a* and the first abutment surface 10*a* of the stopper 10.

Figure 10:
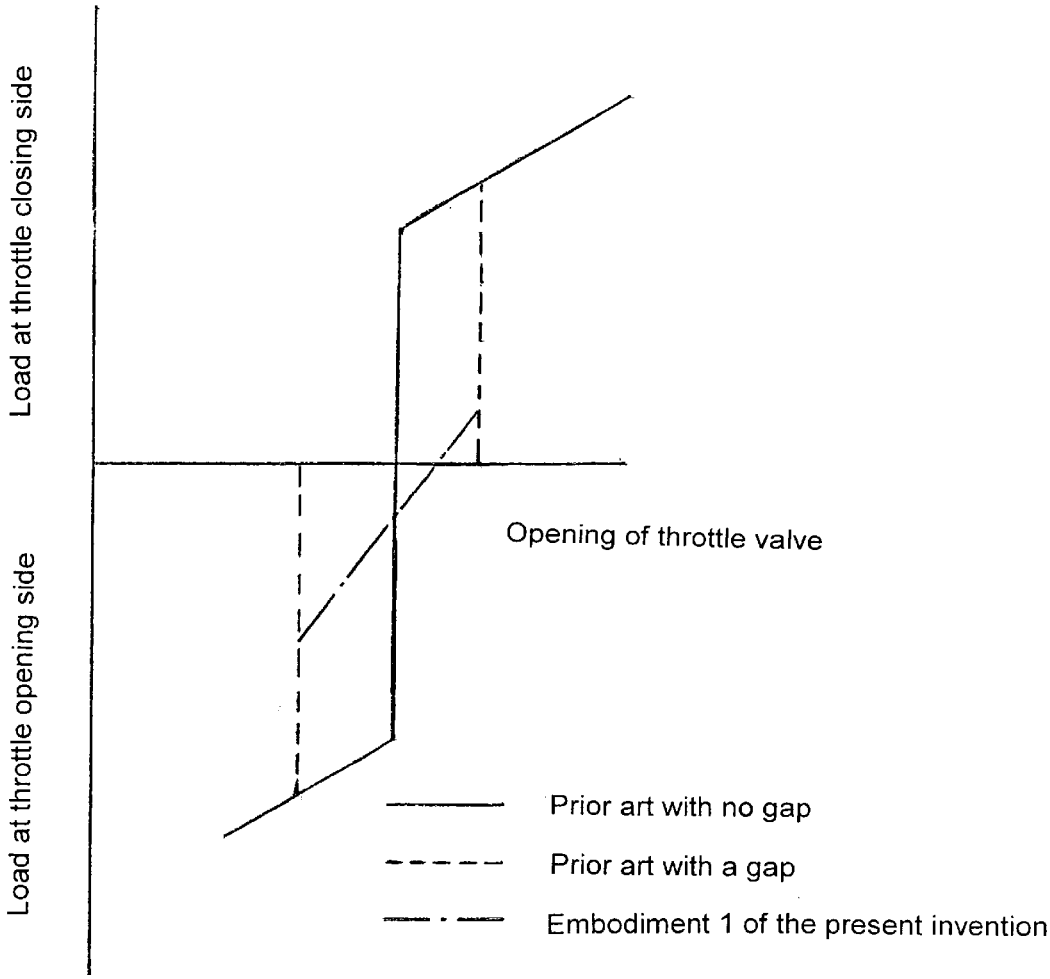
FIG. 10 is a view showing the relation between the opening of a throttle valve and the load on a throttle gear.

The alternate long and short dash line in FIG. 10 represents the relation between the load on the throttle gear 5 and the opening of the throttle valve 4 at this time. From this figure, it is clear that the opening of the throttle valve 4 can be controlled in accordance with the amount of electric power supplied to the motor 8 even in the rotational range of the gap A.

Here, note that when the throttle valve 4 is in its fully closed position, the second extension 5*b* and the second engagement portion 9*b* are in abutment with each other, and the first engagement portion 9*a* and the first abutment surface 10*a* are also in abutment with each other, so the elastic force of the elastic member 9 acts on the throttle valve 4 in the opening direction.

On the other hand, when the throttle valve 4 is in its fully opened position, the first extension 5*a* and the first engagement portion 9*a* are in abutment with each other, and the second engagement portion 9*b* and the second abutment surface 10*b* are also in abutment with each other, so the elastic force of the elastic member 9 acts on the throttle valve 4 in the closing direction.

Embodiment 2.

Figure 4:
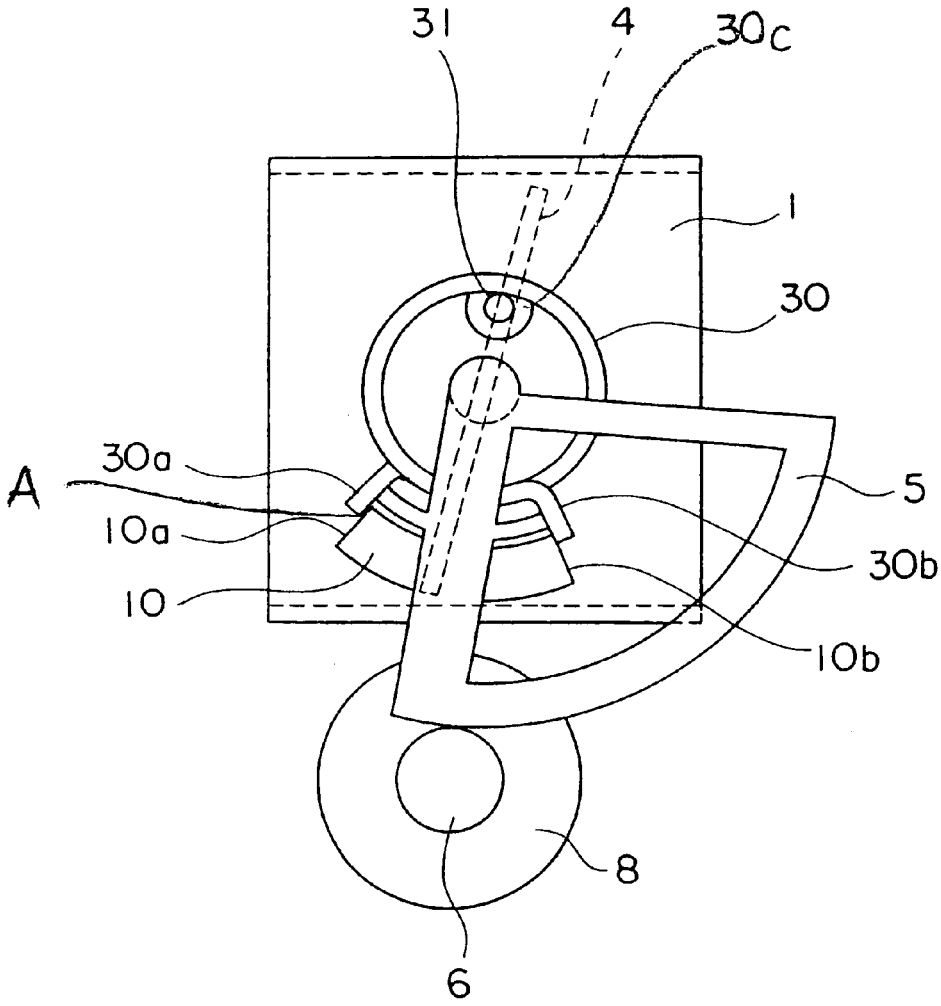
FIG. 4 is a front elevational view of an intake air throttle valve device according to a second embodiment of the present invention.
Figure 5:
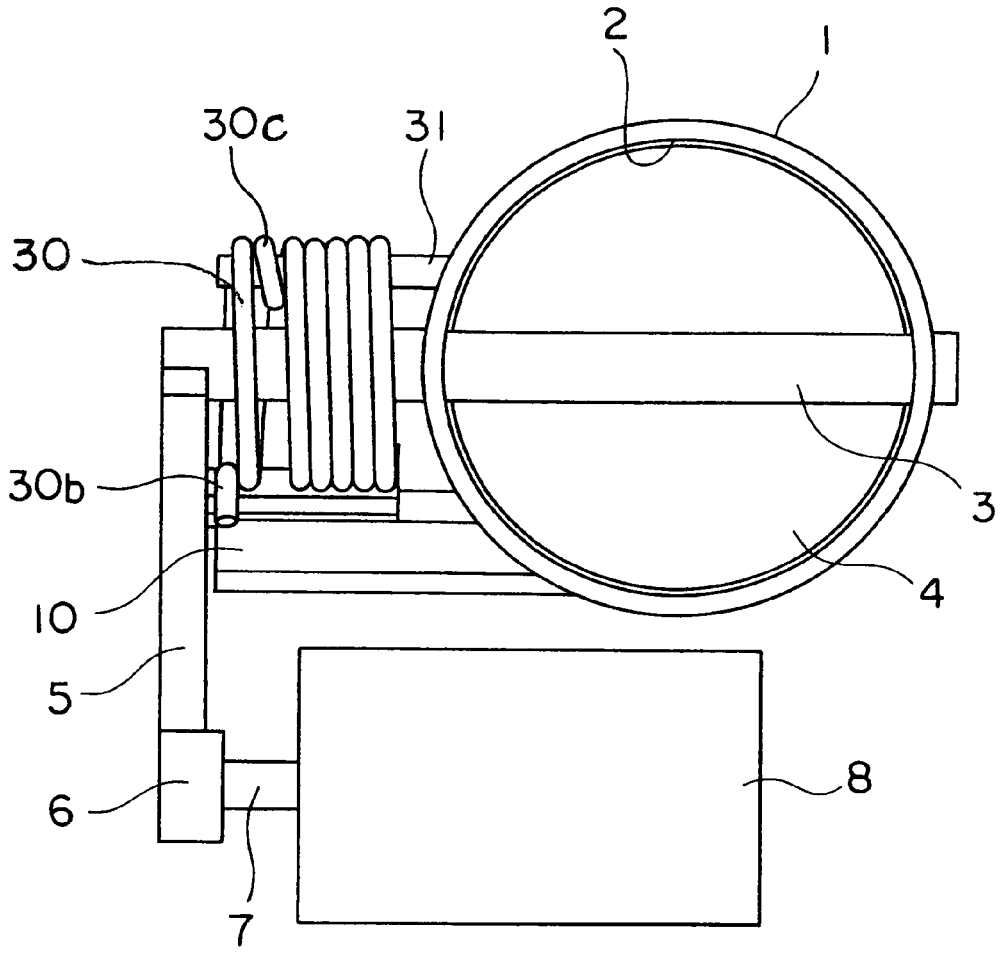
FIG. 5 is a side view of the intake air throttle valve device of FIG. 4.
Figure 6:
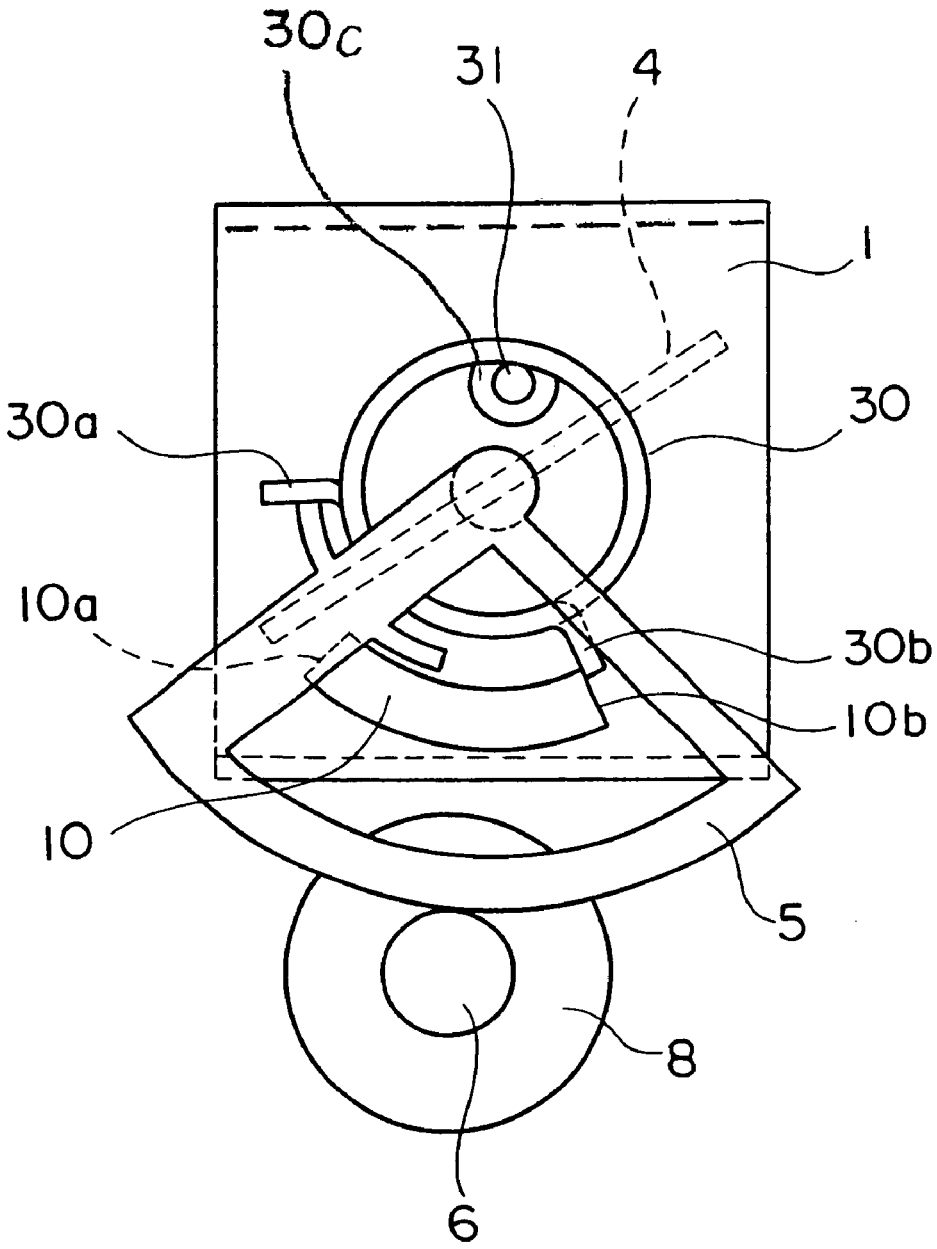
FIG. 6 is a front elevational view showing another mode of use of the intake air throttle valve device of FIG. 4.

FIG. 4 is a front elevational view of an intake air throttle valve device according to a second embodiment of the present invention. FIG. 5 is a right side view of the intake air throttle valve device of FIG. 4. FIG. 6 shows another mode of use of the intake air throttle valve device of FIG. 4.

This embodiment is different from the intake air throttle valve device of the first embodiment in the following features. That is, a coiled torsion spring 30 having a first engagement portion 30*a* and a second engagement portion 30*b* is used as a resilient means, and a load applying means comprises a third engagement portion 30*c* which is formed in an intermediate portion of the coiled torsion spring 30, and a pin 31 which protrudes from the body 1 and is engaged with the third engagement portion 30*c*. The construction of this embodiment other than the above is similar to the intake air throttle valve device of the first embodiment.

In this embodiment, in cases where there is a gap A between the first engagement portion 30*a* of the coiled torsion spring 30 and the first abutment surface 10*a* of the stopper 10, when the throttle valve 4 is to be turned in the closing or counterclockwise direction, the throttle gear 5 is caused to turn in the counterclockwise direction by the driving force from the motor 8 through the motor gear 6, so that the second extension 5*b* pushes the second engagement portion 30*b* of the coiled torsion spring 30. At this time, the first engagement portion 30*a* does not push the first abutment surface 10*a* of the stopper 10, but the third engagement portion 30*c* is engaged with the pin 31. Accordingly, the coiled torsion spring 30 is subjected to twist deformation, in accordance with which the elastic force of the coiled torsion spring 30 is applied to the throttle gear 5 in the clockwise direction.

That is, the throttle gear 5 receives the elastic force of the coiled torsion spring 30 even when there is the gap A between the first engagement portion 30*a* and the first abutment surface 10*a* of the stopper 10. As a result, even in this rotational range of the gap A, the opening of the throttle valve 4 is changed according to the amount of electric power supplied to the motor 8, thus making it possible to control the opening of the throttle valve 4 in accordance with the amount of electric power supplied to the motor 8.

Although in the above-mentioned embodiments, the resilient means is constructed of the elastic member 9 or the coiled torsion spring 30, it is of course not limited to these elements.

In addition, although the driving force transmission means is comprised of the throttle gear 5, it is not limited to this but may be constructed of any member which is capable of transmitting the driving force of the motor 8 to the throttle shaft 3.

As described in the foregoing, according to the present invention, in an intermediate portion of a resilient means, there is arranged a load applying means for generating a force in the resilient means to oppose the force of a driving force transmission means thereby to apply a load to the driving force transmission means. With such an arrangement, even in the case of an intake air throttle valve device in which there is a gap between an end of the driving force transmission means and an adjacent end face of a stopper, the driving force transmission means is able to receive the elastic force of the resilient means in the entire operating range of the driving force transmission means. As a result, the opening of a throttle valve can be statically determined by balance between the force from the driving force transmission means and the elastic force from the resilient means, thus making it possible to prevent the occurrence of a range in which it is impossible to control the opening of the throttle valve in accordance with the amount of electric power supplied to a motor for driving the throttle valve.

In a preferred form of the present invention, the resilient means comprises an elastic member which has engagement portions formed at opposite ends thereof, respectively, the elastic member being formed of rubber in the form of a segmental shape which is a partially cut-away circle. Thus, with a simple construction, it is possible to obtain an elastic force, which acts in a direction to oppose the force of the driving force transmission means.

In another preferred form of the present invention, the load applying means comprises an engagement portion protruding from an intermediate portion of the elastic member in a diametral direction thereof, and a pair of abutment portions with the engagement portion of the body being clamped therebetween in abutment therewith so that a load is generated by the compressive deformation of the elastic member. Thus, with a simple construction, it is possible to provide a load on the driving force transmission means according to the compressive deformation of the elastic member.

In a further preferred form of the present invention, the resilient means comprises a coiled torsion spring having engagement portions formed at opposite ends thereof, respectively. Thus, with a simple construction, it is possible to provide an elastic force acting in a direction to oppose the force of the driving force transmission means.

In a still further preferred form of the present invention, the load applying means comprises an engagement portion formed in an intermediate portion of the coiled torsion spring, and a pin protruding from the body and being engaged with the engagement portion so that a load is generated by the torsional deformation of the coiled torsion spring. Thus, with a simple construction, it is possible to generate a load on the driving force transmission means according to the torsional deformation of the coiled torsion spring.

In a yet further preferred form of the present invention, the driving force transmission means comprises a throttle gear which is in meshing engagement with a motor gear fixedly secured to a motor shaft of the motor, the throttle gear having a pair of extensions in abutment with engagement portions formed at opposite ends, respectively, of the resilient means. Thus, with a simple construction, the driving force of the motor can be transmitted to the throttle shaft in a reliable manner.

While the invention has been described in terms of preferred embodiments, those skilled in the art will recognize that the invention can be practiced with modifications within the spirit and scope of the appended claims.

What is claimed is:

1. An intake air throttle valve device comprising:

a motor;

a body having an intake passage formed therein;

a throttle shaft extending through said body;

a throttle valve fixedly secured to said throttle shaft;

driving force transmission means fixedly attached to an end portion of said throttle shaft for transmitting a driving force from said motor to said throttle shaft thereby to open or close said throttle valve; and resilient means arranged to surround said throttle shaft for stopping said throttle valve at a prescribed angle of rotation by balance between a force from said driving force transmission means and an opposing elastic force of said resilient means, said resilient means having a protruded portion;

wherein said resilient means is engaged at one end thereof with an end face of a stopper provided on said body, and at the other end thereof with said driving force transmission means, so that the elastic force of said resilient means can be changed by the deformation of said resilient means in accordance with the operation of said driving force transmission means, and wherein in an intermediate portion of said resilient means there is provided a load applying means for causing said elastic means to generate a force to oppose the force of said driving force transmission means thereby to apply a load to said driving force transmission means, said load applying means disposed to limit movement of said protruded portion when said throttle valve is opened.

2. The intake air throttle valve device according to claim 1, wherein said resilient means comprises an elastic member which has engagement portions formed at opposite ends thereof, respectively, said elastic member being formed of rubber in the form of a segmental shape which is a partially cut-away circle.

3. The intake air throttle valve device according to claim 2, wherein said load applying means comprises an engagement portion formed from a part of said protruded portion at an intermediate portion of said elastic member in a diametral direction thereof, and a pair of abutment portions with said engagement portion being clamped therebetween in abutment therewith so that a load is generated by the compressive deformation of said elastic member.

4. The intake air throttle valve device according to claim 1, wherein said resilient means comprises a coiled torsion spring having engagement portions formed at opposite ends thereof, respectively.

5. The intake air throttle valve device according to claim 4, wherein said load applying means comprises an engagement portion formed from a part of said protruded portion at an intermediate portion of said coiled torsion spring, and a pin protruding from said body and being engaged with said engagement portion so that a load is generated by the torsional deformation of said coiled torsion spring.

6. The intake air throttle valve device according to claim 1, wherein said driving force transmission means comprises a throttle gear which is in meshing engagement with a motor gear fixedly secured to a motor shaft of said motor, said throttle gear having a pair of extensions in abutment with engagement portions formed at opposite ends, respectively, of said resilient means.

7. The intake air throttle valve device according to claim 1, wherein said load applying means is disposed to also limit movement of said protruded portion when said throttle valve is closed.

8. An intake air throttle valve device comprising:

a motor;

a body having an intake passage formed therein;

a throttle shaft extending through said body;

a throttle valve fixedly secured to said throttle shaft;

driving force transmission means fixedly attached to an end portion of said throttle shaft for transmitting a driving force from said motor to said throttle shaft thereby to open or close said throttle valve; and resilient means arranged to surround said throttle shaft for stopping said throttle valve at a prescribed angle of rotation by balance between a force from said driving force transmission means and an opposing elastic force of said resilient means;

wherein said resilient means is engaged at one end thereof with an end face of a stopper provided on said body, and at the other end thereof with said driving force transmission means, so that the elastic force of said resilient means can be changed by the deformation of said resilient means in accordance with the operation of said driving force transmission means, wherein in an intermediate portion of said resilient means there is provided a load applying means for causing said elastic means to generate a force to oppose the force of said driving force transmission means thereby to apply a load to said driving force transmission means, and wherein said resilient means comprises an elastic member which has engagement portions formed at opposite ends thereof, respectively, said elastic member being formed of rubber in the form of a segmental shape which is a partially cut-away circle.

9. The intake air throttle valve device according to claim 8, wherein said load applying means comprises an engagement portion protruding from an intermediate portion of said elastic member in a diametral direction thereof, and a pair of abutment portions with said engagement portion being clamped therebetween in abutment therewith so that a load is genera ted by the compressive deformation of said elastic member.

10. An intake air throttle valve device comprising:

a motor;

a body having an intake passage formed therein;

a throttle shaft extending through said body;

a throttle valve fixedly secured to said throttle shaft;

driving force transmission means fixedly attached to an end portion of said throttle shaft for transmitting a driving force from said motor to said throttle shaft thereby to open or close said throttle valve; and resilient means arranged to surround said throttle shaft for stopping said throttle valve at a prescribed angle of rotation by balance between a force from said diving force transmission means and an opposing elastic force of said resilient means;

wherein said resilient means is engaged at one end thereof with an end face of a stopper provided on said body, and at the other end thereof with said driving force transmission means, so that the elastic force of said resilient means can be changed by the deformation of said resilient means in accordance with the operation of said driving force transmission means, wherein in an intermediate portion of said resilient means there is provided a load applying means for causing said elastic means to generate a force to oppose the force of said driving force transmission means thereby to apply a load to said driving force transmission means, and wherein said driving force transmission means comprises a throttle gear which is in meshing engagement with a motor gear fixedly secured to a motor shaft of said motor, said throttle gear having a pair of extensions in abutment with engagement portions formed at opposite ends, respectively, of said resilient means.

* * * * *